US005972065A

United States Patent [19]

Dunn et al.

[11] Patent Number: 5,972,065

[45] Date of Patent: Oct. 26, 1999

[54] PURIFICATION OF TANTALUM BY PLASMA ARC MELTING

[75] Inventors: Paul S. Dunn, Santa Fe; Deniece R. Korzekwa, Los Alamos, both of N.Mex.

[73] Assignee: The Regents of the University of California, Los Alamos, N.Mex.

[21] Appl. No.: 08/891,662

[22] Filed: Jul. 10, 1997

[51] Int. Cl.[6] ..... C21B 11/10; C22B 34/10; C01G 31/00

[52] U.S. Cl. ..... 75/10.19; 75/10.29; 75/10.43; 75/10.45; 75/612; 423/62

[58] Field of Search ..... 75/10.19, 10.28, 75/10.29, 231, 232, 234, 244, 336, 338, 396, 397, 398, 10.43, 10.45, 612; 423/62

[56] References Cited

U.S. PATENT DOCUMENTS

| | | | |
|---|---|---|---|
| 4,727,928 | 3/1988 | De Vynck et al. | 164/469 |
| 4,743,297 | 5/1988 | Kopatz . | |
| 5,239,162 | 8/1993 | Haun . | |

OTHER PUBLICATIONS

C. V. Robino, "Representation of Mixed Reactive Gases on Free Energy (Ellingham–Richardson) Diagrams", *Metallurgical and materials Transactions B*, vol. 27B, Feb. 1996, pp. 65–69.

Kouji Mimura and Michio Nanjo, "Production of Pure Tantalum by Carbon–Reduction Smelting and Hydrogen Plasma–Arc Melting with Refining", *Materials Transactions, JIM*, vol. 31, No. 4 (1990), pp. 293–301. No Month.

Kouji Mimura and Michio Nanjo, "Recent Developments in Plasma Metal Processing", *High Temp. and Mat. Process.*, vol. 7, No. 1, 1986, pp. 1–16.

P. S. Dunn, D. R. Krozekwa, and F. G. Garcia, "Chemistry Modification of High Oxygen Carbon Powder by Plasma Melting", in *Tantalum*, Proceedings at the 125 TMS Annual Meeting and Exhibit, Annaheim CA, Feb. 5–8, 1996, ed. by E. Chen, A Crowson, E. Lavernia, W. Ebihara, and P. Kumar, Minerals, Metals and Materials Soc, 1996, pp. 325–334.

*Primary Examiner*—George Wyszomierski
*Assistant Examiner*—Tima McGuthry-Banks
*Attorney, Agent, or Firm*—Samuel L. Borkowsky

[57] ABSTRACT

Purification of tantalum by plasma arc melting. The level of oxygen and carbon impurities in tantalum was reduced by plasma arc melting the tantalum using a flowing plasma gas generated from a gas mixture of helium and hydrogen. The flowing plasma gases of the present invention were found to be superior to other known flowing plasma gases used for this purpose.

5 Claims, 2 Drawing Sheets

PURIFICATION OF TANTALUM BY PLASMA ARC MELTING

This invention was made with government support under Contract No. W-7405-ENG-36 awarded by the U.S. Department of Energy to the Regents of the University of California. The government has certain rights in the invention.

FIELD OF THE INVENTION

The present invention relates generally to plasma arc melting and, more particularly, to the purification of tantalum by plasma arc melting in a helium/hydrogen ($He/H_2$) plasma.

BACKGROUND OF THE INVENTION

Refractory metals such as tantalum are important because their physical and/or chemical properties often make them the materials of choice for a variety of applications. For example, the chemical inertness of tantalum makes it a material of choice for use by industries employing corrosive chemicals such as in processes involving sulfuric acid, hydrochloric acid, hydrobromic acid, nitric acid, and chlorine. Tantalum is also used in the pharmaceutical industry for the manufacture of drugs, in the food industries for the processing of food products, and in the oil refining industry for petrochemical processing.

The physical and/or chemical properties of a refractory metal, such as the tensile strength and corrosion resistance, may improve by alloying with another metal or metals. In contrast, these properties may diminish in the presence of unwanted impurities to such a degree that the metal is useless for many important applications. Therefore, the purification of refractory metals is important.

The "Bessemer process" has been used for over 100 years in the purification of iron. It involves directing a blast of air through molten wrought iron (Fe) to produce steel, wherein the oxygen in the air reacts with impurities in the iron to produce volatile oxides and thus purify the iron. Refractory metals may not be suited to purification by the "Bessemer Process" since, unlike iron, refractory metals such as tantalum have much higher melting points and require a higher energy source for melting.

Two relatively recent and commercially important remelting techniques known as "electron beam remelting" (EBR) and "vacuum-arc remelting" (VAR), employ high energy sources and have been successfully used in the purification of refractory metals. Typically, the starting material is placed in a chamber with the energy-generating source, the beam for EBR or the arc for VAR, such that it lies in or can be directed into the path of the beam or arc. The chamber is evacuated, and the corresponding beam or arc is generated and caused to make contact with the starting material, whereupon the starting material rapidly becomes molten. As the melt is generated, it is collected in a cooled vessel such as a cooled copper crucible from which it is recovered. Although excellent results have been obtained using EBR and VAR, both techniques require relatively pure starting materials. Low grade materials, i.e. metals having oxygen impurities above about 5000–10,000 PPM, are not purified by EBR and VAR because extensive outgassing from the material during melting rapidly decreases the vacuum level in the chamber required for sustaining the beam or arc.

Another melting technique known as "plasma arc melting" (PAM) has also been used to purify refractory metals. Instead of a beam or arc heat source, a high temperature plasma is used to melt a refractory metal. This plasma can be generated using a plasma arc torch. For example, see U.S. Pat. No. 5,239,162 by R. E. Haun et al. entitled "Arc Plasma Torch Having Tapered-Bore Electrode," which issued Aug. 24, 1993. In the '162 patent, the operation of the torch is described in column 5, lines 24–33. An electric power source is activated to generate a potential between an electrode and a pool which contains metal, thereby generating an arc between them. Gas is injected into a chamber by the electrode and forced through a nozzle toward the pool. The arc ionizes the gas into a hot plasma gas, which blows against the pool and melts the metal in the pool. Importantly, since PAM is performed under gas pressure rather than under vacuum, the plasma formed is unaffected by outgassing during melting. In contrast to EBR and VAR, PAM has been used in the purification of low grade refractory metals. For a review of plasma metallurgy and plasma melting, which includes plasma arc melting and remelting, see "Recent Developments in Plasma Metal Processing" by K. Mimura et al. in High Temperature Materials and Processes, Vol. 7, No. 1, 1986, pages 1–16.

Generally, PAM involves the exposure of an impure metal to a plasma generated from gases such as argon (Ar) and argon/helium (Ar/He). The plasma formed from these gases may have a temperature range which includes 5,000–10,000° C. Any known metal subjected to a plasma in this temperature range becomes molten. If the chemical composition of the starting impure metal is known, and if it assumed that this composition approximates that of the melt, a purification procedure can be formulated by examining the possible chemical reactions between components in the melt and determining which reactions are thermodynamically favorable under the appropriate conditions. For example, it is known that when carbon is exposed to oxygen at high temperatures, a thermodymically favorable chemical reaction takes place resulting in the formation of carbon monoxide. If a refractory metal having oxygen and carbon impurities is subjected to a high temperature Ar/He plasma, the metal becomes molten and the carbon and the oxygen impurities within the melt combine to produce carbon monoxide. This reaction is known as the carbothermal reaction, and is an efficient means for removing oxygen and carbon from the melt. In addition, oxygen can also be removed from the melt at high enough temperatures by direct volatilization in the absence of carbon.

The removal of oxygen from a metal by PAM may be further enhanced by employing plasmas having high thermal conductivities. For example, the addition of another chemical species to an Ar or Ar/He plasma may increase the thermal conductivity of the resulting plasma. In particular, an $Ar/He/H_2$ plasma has a higher thermal conductivity than an Ar/He plasma, and its higher thermal conductivity results in a more efficient transfer of heat from the plasma to the metal.

Compared to an Ar or an Ar/He plasma, an $Ar/He/H_2$ plasma may also provide additional mechanisms for oxygen removal from the metal. One such mechanism involves the chemical reaction between hydrogen and oxygen within the metal to produce species such as hydroxide (OH) radicals and water molecules ($H_2O$). Support for this mechanism is found in C. V. Robino, "Representation of Mixed Gases on Free Energy (Ellingham-Richardson) Diagrams," by Metallurgical and Material Transactions B, volume 27B (1996) pages 65–69. The Ellingham-Richardson diagram on p. 68 shows a plot of the energy vs. temperature for a variety of oxidation reactions. Each reaction is represented by a single curve in the diagram. Included in the diagram is a curve for the reaction of $H_2$ with oxygen, and a curve for the reaction of H with oxygen. The curve for the former reaction lies at higher energy as compared to the curve for latter, indicating that the latter reaction is thermodynamically more favorable than the former. The diagram also includes a curve for the reaction of carbon with oxygen, i.e. the carbothermal reaction. At temperatures greater than about 2000° C., the position of this curve indicates that the carbothermal reaction is thermodynamically more favorable than the reaction of oxygen with either $H_2$ or H. Therefore, oxygen present in a melt will preferentially react with carbon when exposed to a hydrogen-containing plasma.

A process employing an $Ar/He/H_2$ plasma for processing metal powder into metal flakes is described et al. in U.S. Pat. No. 4,743,297 by Kopatz et al. entitled "Process For Producing Metal Flakes", which issued on May 10, 1988. This process includes the steps of melting metal powder particles in flight in the plasma, impinging the melt on a rapidly spinning cold disc to produce flakes, and applying a jet of non-oxidizing gas to remove the solidified flakes from the disc. Although the '297 Patent mentions in column 2, lines 9–11 that "if necessary, the starting powders are exposed to temperatures and controlled environment to remove carbon, oxygen, etc.," the conditions for removal of carbon, oxygen, etc. from specific metals are not described.

The reduction of tantalum oxide ($Ta_2O_5$) by PAM is described by K. Mimura et al. in "Production of Pure Tantalum by Carbon-Reduction Smelting and Hydrogen Plasma-Arc Melting with Refining," by Met. Trans., JOM, 31, 10, 1990, pages 293–301. Mimura et al. reduce $Ta_2O_5$ to tantalum metal (Ta) by mixing $Ta_2O_5$ with carbon and subjecting the mixture to an Ar or $Ar/H_2$ plasma, wherein the carbon reacts with the oxygen to form carbon monoxide, leaving tantalum metal in highly purified form. Mimura et al. describe the mixing of graphite powder with $Ta_2O_5$ powder at mole ratios between 4.50–5.50, pressing the powder into pellets, preheating the pellets to prevent scattering of the pellets during smelting, smelting the pellets with either an Ar plasma or an $Ar/H_2$ plasma, and comparing the effects of a chosen plasma composition to the corresponding chemical composition of the purified tantalum-containing products. Mimura et al. generally employ a melt rate of about 1 gram/min. Mimura et al. state that the final product composition is dependent on the initial $C/Ta_2O_5$ ratio. For example, a $C/Ta_2O_5$ ratio of 5.10 gives a button-like product with metallic luster, whereas a $C/Ta_2O_5$ ratio of 4.50 gives a flat plate with a black surface. As the $C/Ta_2O_5$ ratio is increased, the amount of carbon in the final product also increases while the amount of oxygen in the final product decreases.

Chemical extraction techniques have successfully been used for the purification of refractory metals. However, chemical extraction is laborious and generally results in the production of unwanted chemical waste by-products.

In view of the current attitude regarding the conservation and optimum use of natural resources, the commercial recycling of spent metals is important. Therefore, an object of the present invention is to provide a process for removing carbon and oxygen impurities from tantalum.

Another object of the invention is to provide a process to convert low grade tantalum to a purity suitable for further processing by EBR and VAR.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention as embodied and broadly described herein, the present process for removing oxygen and carbon from tantalum metal by plasma arc melting includes the steps of placing tantalum metal into a vessel, generating a flowing plasma gas from a flowing gas mixture in a plasma torch, the gas mixture consisting of helium and hydrogen, exposing the metal to the flowing plasma gas for a period of time, thereby melting and mixing the tantalum, whereby oxygen combines with carbon and hydrogen in the tantalum to generate volatile oxides of carbon and of hydrogen, thereby purifying the tantalum.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE INVENTION

Figure 1:
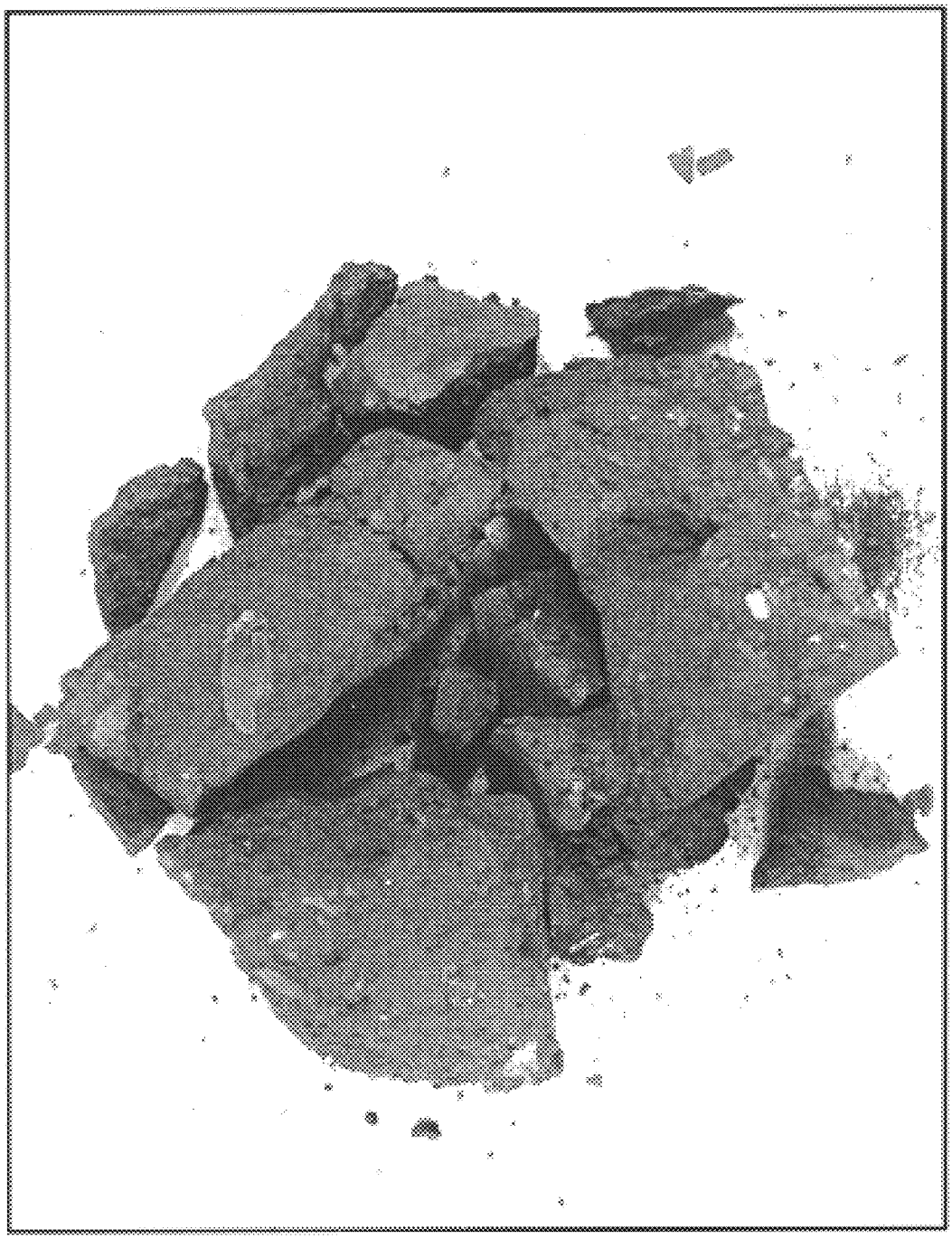
FIG. 1 is a macrograph showing the low grade Ta material used in the demonstration of the present invention. The light colored particles in the material contain a high percentage of $Ta_2O_5$.
Figure 2:
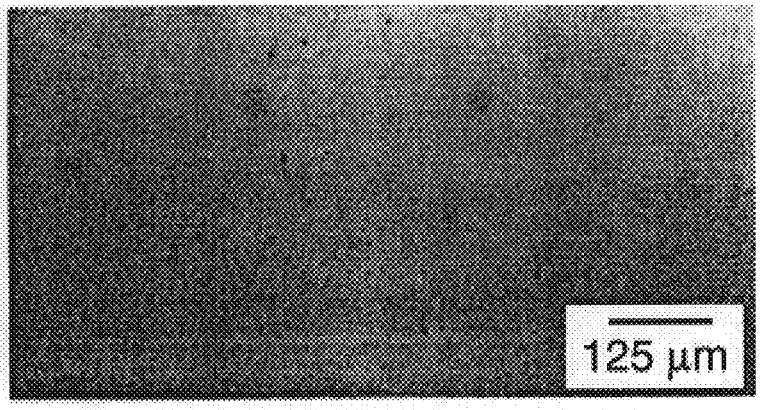
FIG. 2 is a micrograph of a cross section of an ingot of Ta which was produced by applying the process of the present invention to a sample of the low grade Ta powder shown in FIG. 1.

Briefly, the invention is a process for purifying Ta by exposing it to a flowing gas plasma. A macrograph of the low grade Ta used to demonstrate the present invention is shown in FIG. 1. As can be seen in FIG. 1, the tantalum used had many different shapes and sizes, including powder. This material was analyzed for oxygen, carbon, and hydrogen content. The results of the analysis are summarized in Table 1 below.

TABLE 1

| Element | Oxygen (O) | Carbon (C) | Hydrogen (H) |
|---|---|---|---|
| Composition | 10700 | 15810 | 6 |

Samples of Ta having the composition of Table 1 and weighing about 2500 g were subjected to EBR for purification. However, purification by EBR was unsuccessful because outgassing from the samples during melting significantly reduced the intensity of the electron beam.

Samples of Ta having the composition of Table 1 were subjected to PAM. A commercially available plasma torch apparatus was employed to generate the flowing plasma gas. A brief description of the torch and its operation now follow. The plasma torch consists of a hollow electrode, a gas injection ring, and an exit nozzle housed within a water cooled body. The torch is mounted on a water-cooled and electrically insulated tube called a "ram", which is connected to an assembly providing motion to the torch. This motion is controlled either manually by the operator, or by instructions delivered to the ram using a computer. During operation of the torch, a starter power supply provides a high voltage between the electrode and nozzle, thereby generating a pilot arc therebetween. Gas is injected tangentially into the hollow electrode, and carries the arc from the electrode, through the nozzle, and to the grounded workpiece. This arc interacts with the flowing gas to generate a flowing plasma gas which supplies heat to the tantalum, thereby melting it.

Figure 3:
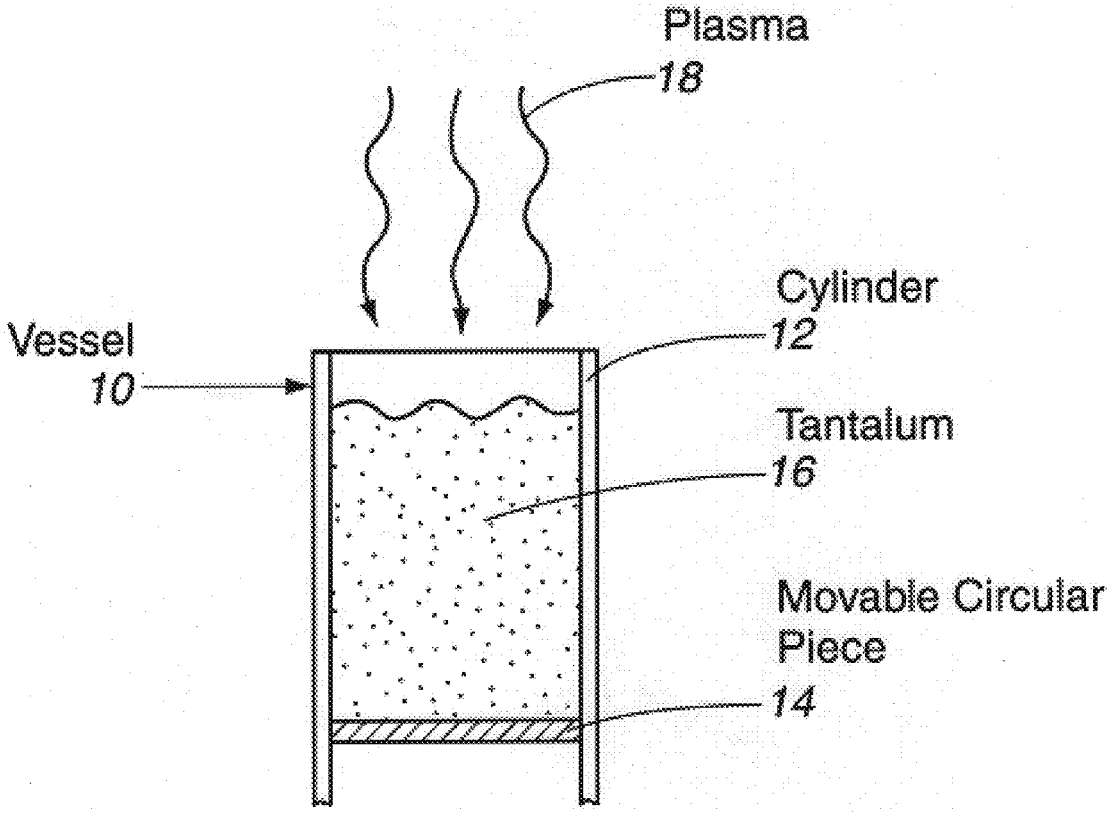
FIG. 3 is a cross-sectional side view of the apparatus used with the present invention.

The tantalum was contained in a cooled copper vessel which consisted of a copper cylinder having an inner diameter of about 100 mm, and a circular bottom piece, the diameter of the bottom piece chosen so that it made a snug fit with the inside of the cylindrical piece. The position of the bottom piece could be adjusted inside the cylinder, thereby allowing a range of volumes for the copper vessel. A cross-sectional side view of the apparatus used is shown in FIG. 3. A dither control, which provided oscillatory motion to the bottom piece of the copper vessel was adjusted so that this piece oscillated 0.1" at a rate of about 0.1 inch/sec. This motion prevented molten tantalum from solidifying on the inner wall of the copper vessel, thus facilitating removal of a tantalum ingot therefrom. The vessel and torch were contained in an evacuable chamber having a viewing window.

The following procedure was used for PAM of tantalum. All parameters chosen were substantially the same for all plasma gases generated. The copper vessel was filled to within about an inch of the top with about 2500 g of the tantalum depicted in FIG. 1. The chamber was sealed, evacuated to a pressure of about 50 microns of mercury, and then back-filled with the gas used to generate the flowing plasma gas. The torch was programmed to move in a circular pattern above the tantalum. After positioning the plasma torch at a chosen position above the tantalum, a pilot arc was generated between the electrode and the nozzle of the plasma torch. Gas, under a pressure of about 50–65 PSI, was injected into the electrode. Upon exiting the nozzle in the direction of the tantalum, the flowing gas caused the production of an arc between the torch and the tantalum. Upon interacting with the flowing gas, the arc caused the production of a flowing plasma gas which melted and mixed the tantalum in the copper vessel. As the pressure inside the chamber increased during melting, gas within the chamber was vented thereby attenuating the pressure.

Each sample was melted in two separate stages. The first stage included exposing the sample to the flowing plasma gas for about 8 minutes. After cooling, the now partially-formed ingot was removed, inverted, and replaced in the copper vessel so that the previously unexposed portion now faces the torch. During the second stage, the sample was exposed to the flowing plasma gas for an additional 8 minutes. After cooling and solidification, the purified tantalum ingot was removed, weighed, and analyzed for C, H, and O content.

Several flowing plasma gases generated from gas combinations reported by Mimura et al. were used to provide a comparison with the plasmas of the present invention. The comparison plasma gases were generated from Ar, 3% $H_2$ in Ar, 6% $H_2$ in Ar, and He. The plasmas gases, which are the subject of the present invention, were generated from gas mixtures of 3% $H_2$ in He and 6% $H_2$ in He. The analysis results, in units of PPM, are summarized in Table 2.

TABLE 2

| Plasma Gas | Oxygen | Carbon | Hydrogen |
|---|---|---|---|
| Ar | 7541 | 1427 | 66 |
| 3% $H_2$ in Ar | 6724 | 758 | 57 |
| 6% $H_2$in Ar | 7123 | 2466 | 23 |
| He | 6334 | 371 | 146 |
| 3% $H_2$ in He | 6506 | 984 | 56 |
| 6% $H_2$in He | 4403 | 130 | 26 |

In general, exposure of low grade Ta to helium-containing plasmas resulted in ingots having a lower concentration of oxygen and carbon when compared to exposure to argon containing plasmas. The last entry shows the superior results obtained by exposure of the low-grade tantalum to a plasma gas made from 6% $H_2$ in He.

The inventors believe that increasing the hydrogen content of a plasma from 3% to 6% should result in an ingot having a lower carbon and oxygen content. It is unclear why the plasma generated from 6% $H_2$ in Ar resulted in an ingot having a higher oxygen content than the ingot obtained with a plasma generated from 3% $H_2$ in Ar gas. One possible explanation is that the carbon and oxygen present in the melt generated by the 6% $H_2$ in Ar plasma may not have sufficiently combined and reacted due to inefficient mixing within the melt.

The present inventors believe that helium plasmas provide thermodynamic advantages over argon plasmas. As a plasma makes contact with the low grade Ta, a molten metal pool is formed. Since the plasma generated from 6% $H_2$ in He is hotter than all other plasmas generated from gases listed in Table 2, the corresponding molten metal pool resulting from this plasma is also hotter than the molten metal pools generated by the other plasmas. This hotter metal pool provides thermodynamic advantages over the cooler metal pools for the purification of tantalum. For example, the production of CO from the reaction of C and O is enhanced at higher temperatures since the free energy of formation of CO increases with increasing temperature. Also, the decomposition of $Ta_2O_5$ is enhanced at higher temperatures since the free energy of formation of $Ta_2O_5$ decreases with increasing temperature. Additionally, the dissociation of $H_2$ into monatomic hydrogen (H) is also enhanced at higher temperatures, further promoting the reaction of H with oxygen and thus promoting the removal of oxygen from the melt.

The foregoing description of the invention has been presented for purposes of illustration and description and is not intended to be exhaustive or to limit the invention to the precise form disclosed, and obviously many modifications and variations are possible in light of the above teaching.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A process for reducing the level of oxygen and carbon impurities in tantalum, comprising the steps of:

a. generating a flowing plasma gas from a flowing gas mixture consisting of helium and hydrogen in a plasma arc torch; and b. exposing the tantalum to the flowing plasma gas for a period of time, thereby melting and mixing the tantalum, whereby oxygen impurities combine with carbon impurities and hydrogen in the tantalum to generate volatile oxides of carbon and volatile oxides of hydrogen, thereby purifying the tantalum.

2. The process as described in claim 1, wherein said gas mixture contains about 3–6% hydrogen gas.

3. The process as described in claim 1, wherein the purified tantalum of said step b is subjected to electron beam remelting.

4. The process as described in claim 1, wherein the purified tantalum of said step b is subjected to vacuum arc remelting.

5. The process as described in claim 1, wherein the tantalum is placed in a copper cylinder having an open first end and a closed second end, the open first end being exposed to the flowing plasma gas, the closed second end being closed by a circular piece movably disposed within the cylinder, whereby the location of the circular piece defines the volume of the cylinder that contains the tantalum, the location of the circular piece being periodically varied in order to prevent molten tantalum from solidifying on the inner wall of the cylinder, thereby facilitating removal of the tantalum therefrom.

* * * * *